US006796325B1

(12) United States Patent
Courier

(10) Patent No.: US 6,796,325 B1
(45) Date of Patent: Sep. 28, 2004

(54) APPARATUS FOR STORMWATER RETENTION AND RELEASE, AND METHOD OF USE THEREOF

(75) Inventor: Stuart Francis Courier, Halesowen (GB)

(73) Assignee: Bryant Group PLC (GB)

( * ) Notice: Subject to any disclaimer, the term of this patent is extended or adjusted under 35 U.S.C. 154(b) by 200 days.

(21) Appl. No.: 10/111,762

(22) PCT Filed: Oct. 25, 2000

(86) PCT No.: PCT/GB00/04097

§ 371 (c)(1),
(2), (4) Date: Aug. 27, 2002

(87) PCT Pub. No.: WO01/31129

PCT Pub. Date: May 3, 2001

(30) Foreign Application Priority Data

Oct. 27, 1999 (GB) ..... 9925384

(51) Int. Cl.[7] ..... E03F 1/00; E03F 5/10

(52) U.S. Cl. ..... 137/357; 137/576; 137/590.5; 52/16; 405/52

(58) Field of Search ..... 137/236.1, 357, 137/576, 590, 590.5; 52/16; 405/36, 41, 52, 53

(56) References Cited

U.S. PATENT DOCUMENTS 4,620,817 A * 11/1986 Cushing ..... 137/357
4,700,734 A * 10/1987 McCauley ..... 137/236.1
4,934,404 A * 6/1990 DeStefano ..... 137/357
5,195,284 A * 3/1993 Florence ..... 52/16
5,234,286 A * 8/1993 Wagner ..... 405/53
5,239,794 A * 8/1993 Klein ..... 52/16
5,342,144 A * 8/1994 McCarthy ..... 405/36
5,735,304 A * 4/1998 Chumley ..... 137/357
5,759,415 A * 6/1998 Adams ..... 210/776
6,357,183 B1 * 3/2002 Smith ..... 52/16

* cited by examiner

*Primary Examiner*—John Rivell
(74) *Attorney, Agent, or Firm*—Michael D. Rechtin; Foley & Lardner LLP

(57) ABSTRACT

Apparatus and a method are aimed at reducing flood risk from stormwater draining from a property (1). The apparatus is adapted in use to retain stormwater at the property (1) releasing it from the property and comprises a container (6) which in use is located underneath or proximal to a building (2) of the property (1), and a control chamber (3) with which the container (6) is in fluid communication. The apparatus is operatively connected in use by at least one conduit (4) to drainage means (5) sourced externally from the building to receive stormwater into the container (6) by way of the control chamber (3), and is further operatively connected in use to at least a second conduit (7) to which stormwater exits from the container (6) by way of the control chamber (3). A level of stormwater in the control chamber (3) determines the inflow and outflow of stormwater into and from the container (6). Debris is prevented at the control chamber from entering into the container and passing to the second conduit (7). Stormwater may be pumped from the container for watering a garden or other uses. The property (1) may comprise a series of buildings (2), each with its own stormwater retention.

29 Claims, 6 Drawing Sheets

APPARATUS FOR STORMWATER RETENTION AND RELEASE, AND METHOD OF USE THEREOF

This invention relates to apparatus for stormwater retention and release, and a method of use thereof. The invention relates more specifically to, but is not limited to, apparatus for stormwater retention and release from a property development.

The term stormwater encompasses water deposited by the weather, and includes snow, hail, rain and ice.

Property developments, especially residential developments, more frequently require that stormwater draining from the property is retained prior to its controlled release in order to reduce flood risks downstream of the site, or to control flows of existing points of outfall with limited spare capacity. Frequently, rates of stormwater discharge from property developments are carefully controlled and restricted, certain controlled rates being set to particularly low levels resulting in large balancing means being necessary to retain the stormwater prior to its controlled release.

The two most frequently used solutions to retain stormwater comprise providing balancing means in the form of a pond or a relatively large tank located in an open space area proximal to the development. If a tank is provided, it may be located under a highway as part of a box culvert. Stormwater collects in the tank or pond and is retained therein prior to release through suitably dimensioned outlets into a local drainage network, usually a sewer.

Ponds are less favoured by developers as they require regular maintenance, and controls connecting the pond to a local drainage network are susceptible to blockage by debris fang into or otherwise gaining access to the pond. Tanks, however, are expensive and also require regular maintenance. Often, developable land must be sacrificed in order to accommodate the pond or tank.

Furthermore, ponds and tanks of the prior art type are laborious to install. Large sewers, usually in the form of relatively large diameter pipework, or box culverts, must be installed underground which requires a significant amount of effort.

Whilst not concerned with control of stormwater control at property developments to reduce flood risks there is disclosure in EP 08253304 A2 of apparatus for separating floating and non-floating particulate from drain water in sudden storms and in steady prolonged rainfall. A tank is connected to inlet and outlet conduits to provide a level of drain water between the conduits and includes particulate containment chambers in which particulate is collected from the water passing through the bank from the inlet to the outlet conduit. In one embodiment a detention basin is provided in combination with the tank into which excessive drain water resulting from higher than usual water flow rates is diverted from the tank. Drain water from the detention basin returns to the tank by a one-way valve for exit from the outlet conduit once the sudden influx of water has passed. The diverted water enters the detention basin at a much higher level than the entry to the outlet conduit, which is in the lower region of the tank. The one-way valve is at the level of the entry to the outlet conduit so that the water is encouraged to leave the detention basin as soon as the sudden influx of water passes. This disclosure is essentially concerned with removal of particulate in a sewer system rather than drain water storage to reduce flood risks.

DE 29611700 U1 discloses the collection of rainwater underneath a building but this is to provide a reservoir of the water for pumping to shower/washing facilities in the building and is not intended to reduce flood risk at a property. Drainage pipes simply feed and drain water directly into and from the foundations of the building where the water is collected.

There is a need in the art for apparatus which can effect stormwater retention and where necessary, controlled release of stormwater from a property development, which overcomes problems discussed above.

According to a first aspect of the invention there is provided stormwater retention apparatus adapted in use to retain stormwater prior to release of the stormwater from a property comprising:

a closed container which in use is located underneath or proximal to a building of the property, being operatively connected in use by at least one inlet conduit to drainage means sourced externally from the building to receive stormwater into the container, and being further operatively connected in use to at least one outlet conduit by which stormwater is led away from the container and a control chamber with which the container is in fluid communication and through which stormwater enters, to be stored in, and leaves the container when the stormwater reaches a determining level (W) in the control chamber spaced above the base of the container, characterised in that the inlet and outlet conduits are connected to the control chamber and thereby to the container, and that the outlet conduit comprises an end portion which passes out of the control chamber and includes an entry spaced above the determining level (W) by which stormwater can pass from the control chamber into the end portion to exit from the control chamber, and which by being spaced above the determining level (W) allows stormwater to collect in the container and control chamber above the determining level (W).

The property may be one of a series of properties on a property development. Preferably each property in such a development has stormwater retention apparatus according to the first aspect of the invention, the stormwater exiting from the container of each apparatus into a local sewer.

Preferably the container is subterranean, located under part of the property. Where the property is a house having a garage, the container is conveniently located under the garage, for example.

Advantageously, no pond or tank is required, freeing all available developable land. As the container of the or each stormwater retention apparatus and its conduits are of a considerably smaller scale than prior art ponds and tanks, considerably less effort is required to install apparatus according to the first aspect of the invention.

Furthermore, the apparatus is less susceptible to blockage as very little debris can gain access to the container as it may be sealed off from the environment. Small amounts of debris, such as leaves, may enter the container via the drainage means fitted to the property, but in general are not sufficient to block the entry to the outlet conduit.

Preferably the container is incorporated in the foundations of the property during construction of the property. Preferably the container is made at least in part of bricks and mortar, and may be lined with cement. A waterproof lining may be added to the inside surfaces of the container to prevent leaks occurring.

Drainage means fitted externally to the property preferably comprises guttering and drainpipes which collect stormwater falling on the property, channelling the stormwater to the base of the property and into the container. The drainage means may, however, be any suitable drainage means which is operatively connectable to the container.

The inlet and outlet conduits may be pipes of relatively narrow diameter, for example 75 mm or 100 mm.

Where the discharge from the property is rate limited, the apparatus may include suitable exit rate limiting means. The exit rate limiting means may include a Hydrobrake (Registered Trade Mark). The outlet conduit may include an orifice which is suitably dimensioned so as to restrict the flow of stormwater through the orifice to a predetermined level.

Where no discharge rate applies, no exit rate limiting means is required. In either case, the need for a large tank or pond is obviated by the provision of apparatus according to the first aspect of the invention.

Stormwater entering the container must first pass through the control chamber. The control chamber may be located above or below ground level, or may be partially below ground level. The chamber may be below ground level at a level relating to the invert of the container. The control chamber may be attached to the side of the property underneath which the container is located.

The control chamber may be operatively connected to the container by a hole or holes located in a wall separating the container and the control chamber. The control chamber may be raised above the level of the container to create a split-level stormwater retention apparatus, the stormwater entering the control chamber and passing under gravity into the container via a hole or holes in the separating wall proximal to the base of the control chamber.

The outlet conduit may comprise at least one outlet pipe, an end portion of which sealingly passes through a hole in a wall of the control chamber. The end portion preferably includes a bend, preferably at 90°, so that one open end of the outlet pipe is directed upwards, away from the base of the control chamber. In the wall of the pipe on the underside of the bend, opposite to the base of the control chamber, a suitably dimensioned orifice may be provided at a selected level through which a restricted flow of stormwater can pass out of the control chamber when the stormwater in the control chamber reaches that level.

As the stormwater level rises in the control chamber, the orifice does not become obstructed as debris floating in the stormwater also rises. When the stormwater level rises above the height of the orifice, a small jet is created from the orifice into the pipe, operating under a head of stormwater and ensuring that the orifice remains free of debris.

The control chamber may, at its base, be fitted with a silt trap in which biodegradable debris such as leaves can collect without blocking the passage of stormwater into or out of the container. A weir or weirs to the inlet conduit or conduits may also prevent any solid passing to the container or obstructing the orifice.

In the above-described form of the outlet conduit, the upwardly-directed open end of the outlet pipe acts as an overflow outlet. If the stormwater level in- the container rises above the level of the open end of the outlet pipe, stormwater enters the pipe via the open end of the pipe (in addition to exiting via the orifice situated on the underside of the bend portion of the outlet pipe). The open end is preferably capped with a device which prevents debris entering the outlet pipe in the event of an overflow. The device may be a bird-cage cap to prevent debris accessing the outlet pipe and rodent access into the container from a downstream sewer network.

In order to prevent condensation and damp causing damage to the foundations and underside of the property above the container, air bricks may be included in the upper regions of the foundations to allow venting of water vapour. The air bricks may be provided with insect screens to prevent debris entering the container. The air bricks may also provide a second means of overflow.

Polythene membranes or other waterproof coating such as "SYNTHAPRUFE" (Registered Trade Mark) could be used to line the walls or underside of the floor of the property to protect the property from structural damage caused by damp. In this way, the property is protected from the deteriorating effects of damp as condensation is isolated by the membranes. In any event, it is designed so that stormwater would normally only be retained in the container for a relatively short period after entering the container.

A pump may be provided which pumps stormwater out of the container to recycle the stormwater for other uses, such as watering a garden, flushing toilets or washing a car.

According to a second aspect of the invention there is provided a property comprising a building characterised in that it includes stormwater retention apparatus according to the first aspect of the invention According to a third aspect of the invention, there is provided a method of retaining and controlling discharge of stormwater collected by drainage means fitted to a building, the method comprising the steps of collection of stormwater by said drainage means, retention of the stormwater by stormwater retention apparatus according to the first aspect of the invention, and controlled release of the retained stormwater by the stormwater retention apparatus into local drainage facilities.

There now follows, by way of example only, a detailed description of an embodiment of the invention with reference to the accompanying drawings of which:

Figure 1:
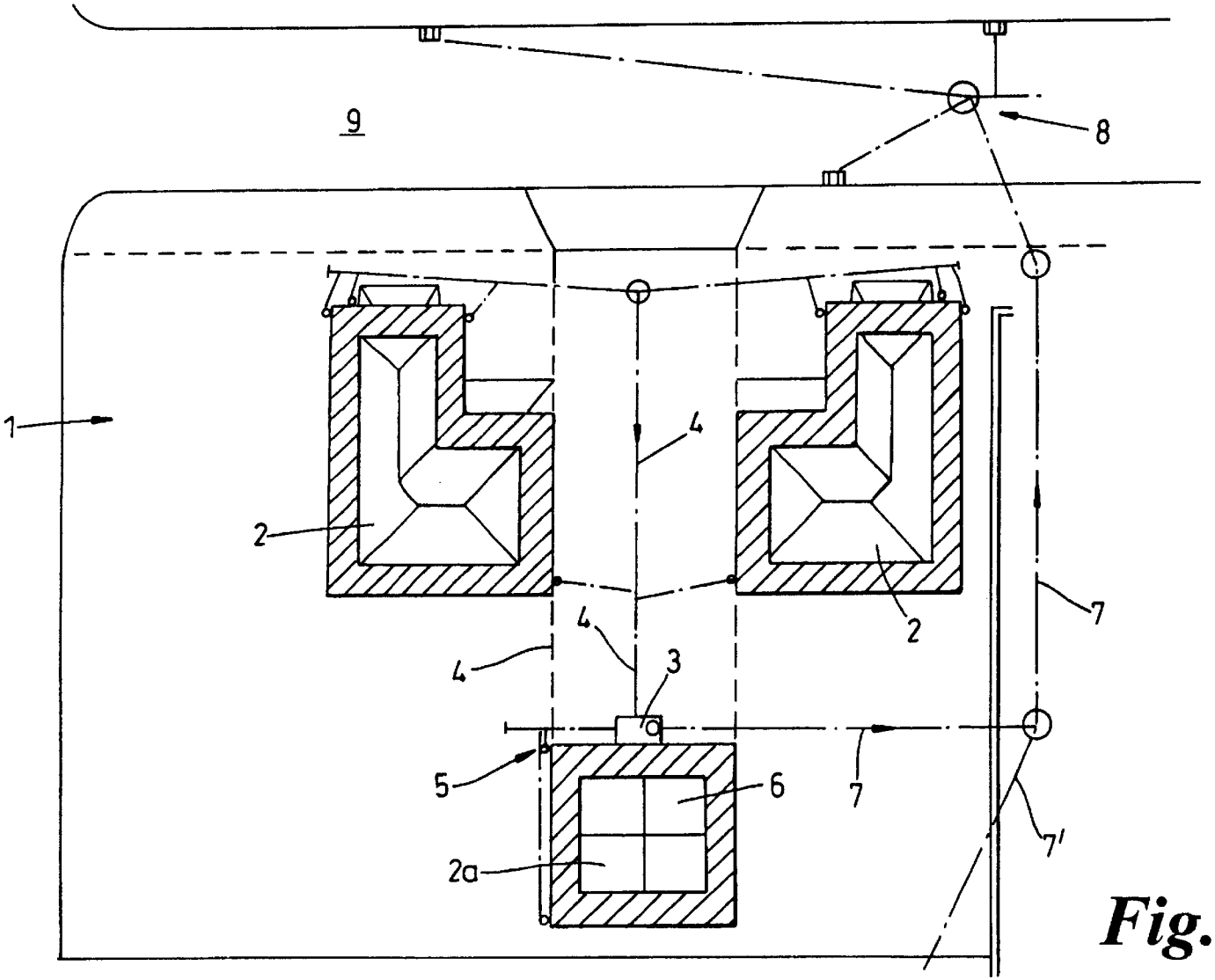
FIG. 1 shows a plan view of two adjacent properties of a property development which include apparatus according to the first aspect of the invention.

FIG. 1 shows part of a property development 1, the part comprising two adjacent houses 2 with adjoining garages built as a divided double garage 2*a*. Adjacent the double garage 2*a* is a control chamber 3. The control chamber 3 is located underground, adjacent the foundations (see FIG. 3) of the double garage 2*a*. Conduits in the form of inlet pipes 4 feed stormwater into the control chamber 3 from the drainage means 5 of the adjacent houses 2 and the garage itself 2*a*. The drainage means 5 generally comprises drainpipes and guttering which collect stormwater falling on the property. A container 6 (see FIG. 2) located under the double garage is operatively connected to the control chamber 3. Walls of the container 6 are defined by the footings of the walls of the double garage 2*a*, as can be seen in FIG. 4.

The control chamber 3 may have a concrete base, brick walls and be closed at the top by an access cover. Alternatively, it may be a pre-formed unit, for example of a suitable plastics material such as upvc.

An outlet conduit 7 allows stormwater to exit from the control chamber 3. The conduit 7 merges with other conduits 7' carrying stormwater from further properties (not shown), feeding the stormwater into a sewer 8 running beneath a nearby road 9.

Figure 2:
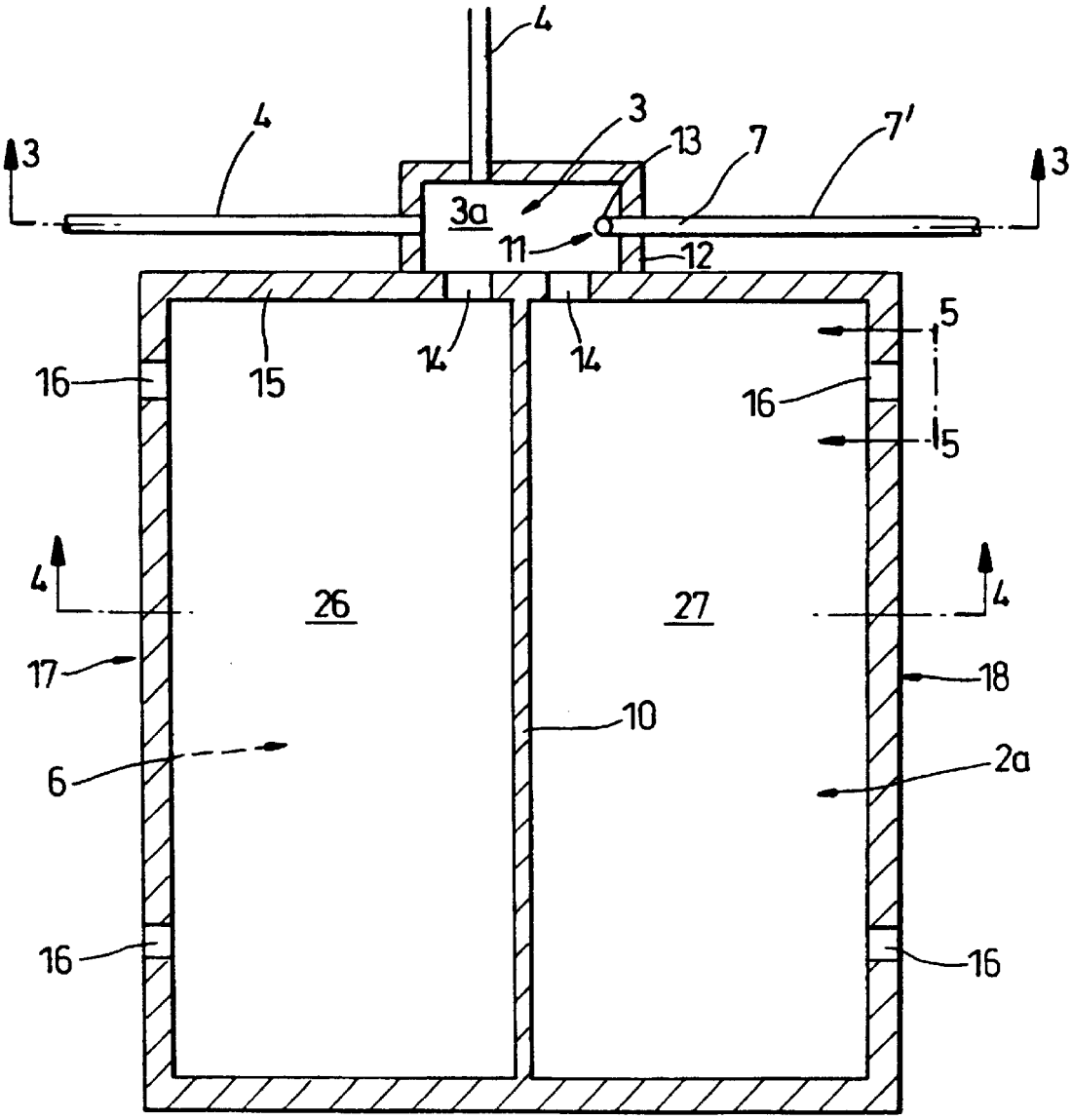
FIG. 2 shows a plan view of apparatus according to the first aspect of the invention provided underneath adjoining garages of the two properties of FIG. 1.

The double garage 2*a*, the control chamber 3 and the conduits 4,7 can be seen in more detail in FIG. 2.

The garage 2*a*, as shown in FIG. 2, is rectangular in plan and divided along its length into halves by a partition wall 10. The control chamber 3 is also rectangular in plan, although any suitable dimensions which allow the control chamber 3 to be located proximal to the foundations of the garage 2*a* would suffice. The partition wall divides the container into two equally-sized sub-chambers 26,27.

Inlet conduits 4 in the form of pipes feed stormwater into the control chamber 3. The outlet conduit 7 also in the form of a pipe provides an outlet for stormwater from the control chamber 3. The inlet and outlet conduits 4, 7 are typically 75 mm or 100 mm diameter. The outlet conduit 7 includes an end portion 11 which sealingly passes through a wall 12 of the control chamber 3 and has an upwardly-directed open end 13.

Holes 14 in a wall 15 of the container, separating the control chamber 3 and the container 6, allow water to pass from the control chamber 3 into the two sub-chambers 26, 27 of the container 6, and vice-versa.

Air bricks 16 at the base of opposite side walls 17,18 of the garage 2*a* allow venting of water vapour in the container 6. The air bricks 16 also provide another means of overflow.

Figure 3:
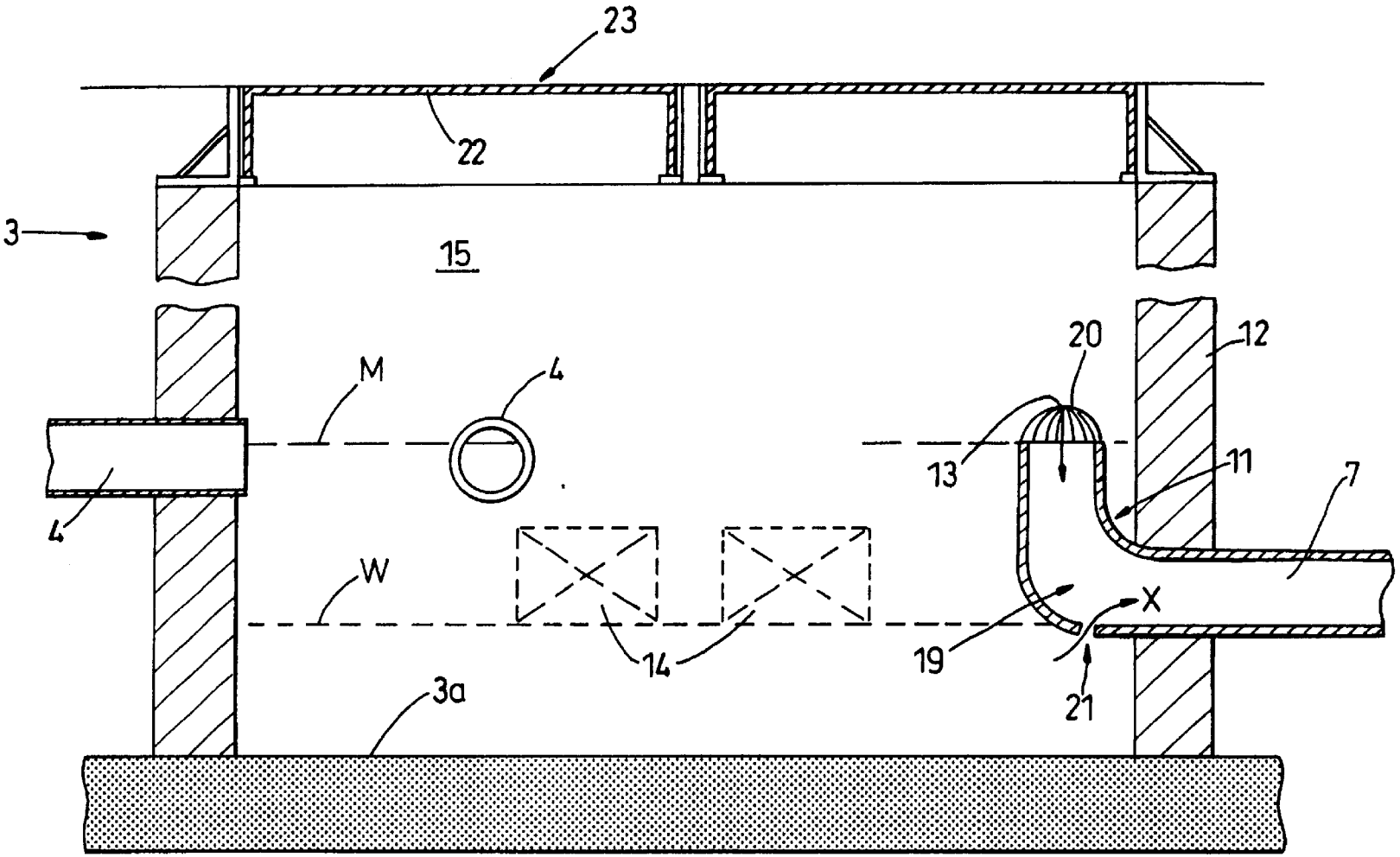
FIG. 3 is an enlarged sectional view along the line 3—3 of a control chamber of the apparatus shown in FIG. 2.
Figure 4:
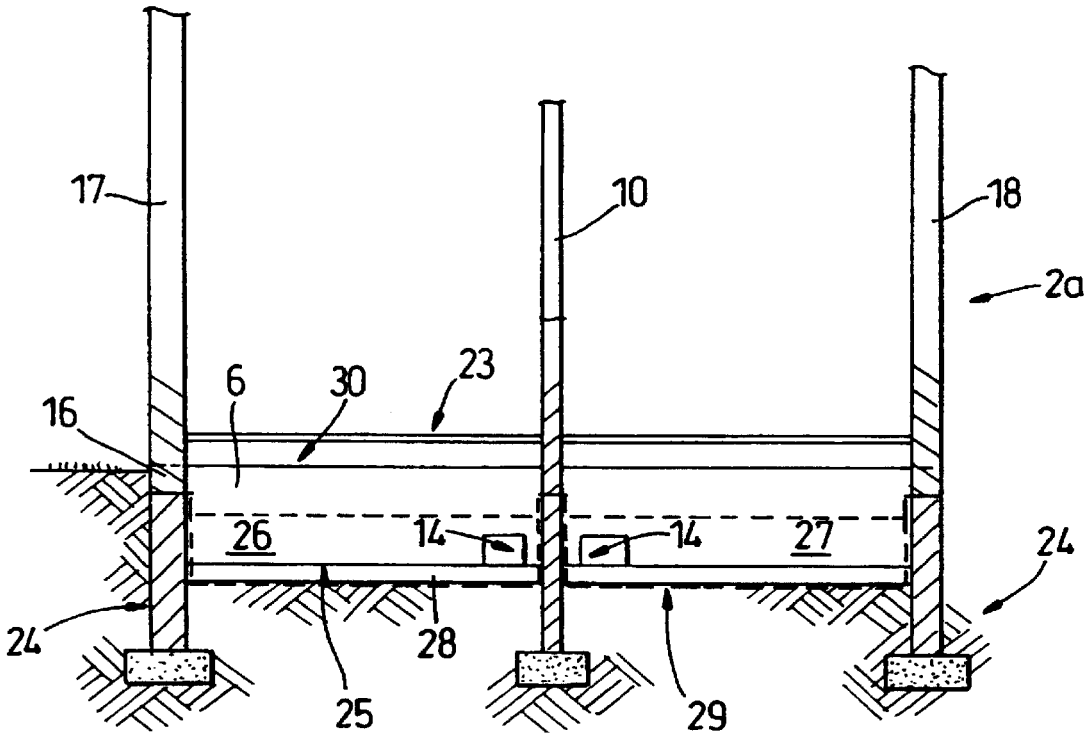
FIG. 4 is a sectional view along the line 4—4 of a container of the apparatus shown in FIGS. 2.

In FIG. 3 the control chamber 3 of FIGS. 1 and 2 can be seen in detail. Inlet pipes 4, delivering water from the drainage means of the property, enter the control chamber 3 at a fixed height above the base 3*a* of the control chamber 3. The soffit of the inlet pipes 4 is typically approximately 25 mm above the maximum possible level of stormwater in the control chamber 3, as indicated by the line M, to prevent the inlet pipes 4 becoming surcharged. If water level is above the stormwater delivery height of the inlet pipes 4, the pipes would become surcharged, impeding the flow of stormwater into the control chamber 3.

The end portion 11 of the outlet conduit 7 has a bend 19, from which the end portion extends upwards away from the base 3*a* of the control chamber 3 to the open end 13, The open end 13 is fitted with a bird cage cap 20, which prevents debris entering the outlet pipe 7 and causing a blockage. This also prevents rodents entering the system from the downstream sewer network 8.

An orifice 21 is formed in the underside of the bend 19 of the end portion 11. As the water level in the control chamber rises, stormwater enters the outlet conduit 7 through the orifice 21, as indicated by the arrow X, thereby exiting in a restricted flow from the control chamber 3 into the nearby sewer 8.

The position of the orifice 21 in the bottom of the bend of the end portion 11 of the outlet conduit prevents debris collecting in the orifice 21 after the water level has fallen. Debris in the control chamber 3 may rise with the water level to, and above, the level of the orifice 21 but after the water level has dropped, gravity prevents debris accumulation in the orifice 21. Furthermore, when stormwater gathers in the control chamber to a level above the level indicated by the line W in FIG. 3, the orifice 21 is submerged in the stormwater, and a restricted flow of stormwater escapes into the outlet conduit 7, through the orifice 21, generating a flume in the outlet conduit from the orifice 21 which ensures that the orifice 21 cannot become blocked.

The holes 14 in the wall 15 between the control chamber 3 and the container 6 allow stormwater to enter the container 6 when the water level in the control chamber rises above the water level W.

The container 6 has a closed roof formed by the underside of a block and beam floor 23 of the double garage 2*a*. A water proofing membrane, for example of SYNTHAPRUFE 22 (Registered Trade Mark), is applied to the underside of the roof of the container. This waterproofing membrane protects the garage 2*a* from damp effecting steel work in the beams of the floor 23.

In addition, the air bricks 16 allow the escape of excess stormwater from the container 6, for example in the event of extreme flooding or collection of stormwater in the container 6, caused by downstream obstruction. The base 25 of the container 6 is lined with a layer, typically 75 mm thick, of smooth formed concrete 28. A polythene membrane 29, typically 1200 g on 50 mm sand blinding, ensures against water escaping from the container 6 to attack the foundations 24. It also diminishes the possibility of the occurance of ground heave in clay subsoils.

Figure 5:
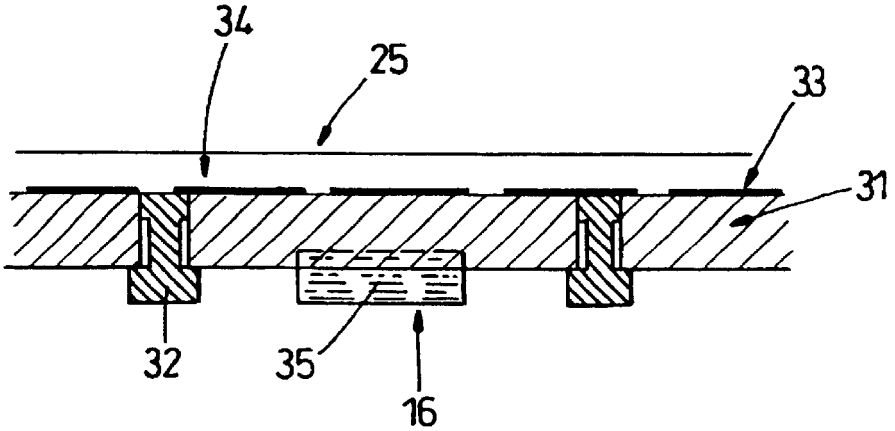
FIG. 5 is a fragmentary sectional view of the floor of one of the garages looking in the direction of the arrows 5—5 in FIG. 2.

In FIG. 5, a section of the garage floor 23 can be seen showing the position of the air bricks 16 in the side walls 17,18 of the garage. The floor typically comprises 100 mm thick blocks 31 and P.C. concrete beams 32, lined with an A96 mesh 33 and covered with a 50 mm structural topping 34. Each air brick 16 is fitted with an insect screen 35 to prevent debris entering the container 6.

In use, stormwater is collected and drained from the property by the drainage means 5 provided on the property 2,2*a*. The stormwater passes through outlet pipes 4 and enters the control chamber 3 at the double garage 2*a*.

Stormwater continues to enter the control chamber 3 until the water level W is reached. Once the water level rises above the water level W (as shown in FIG. 3), stormwater begins to drain into the adjacent subterranean container 6 located underneath the garage 2*a*.

As the stormwater drains into the container 6, it also enters via orifice 21 the outlet pipe 7 and is directed to the nearby sewer 8, joining stormwater draining from neighbouring properties (not shown) on the way.

In the event of serious flooding, when the water level in the container 6 rises above the level M (as shown in FIG. 3), stormwater can then leave also by way of the open end 13 of the pipe 7, which functions as a stormwater overflow in the control chamber 3. Furthermore, if the container 6 is filled to capacity with stormwater through obstruction, the excess stormwater can escape through the air bricks 16 located in the side walls 17,18 of the double garage 2*a*.

Figure 6:
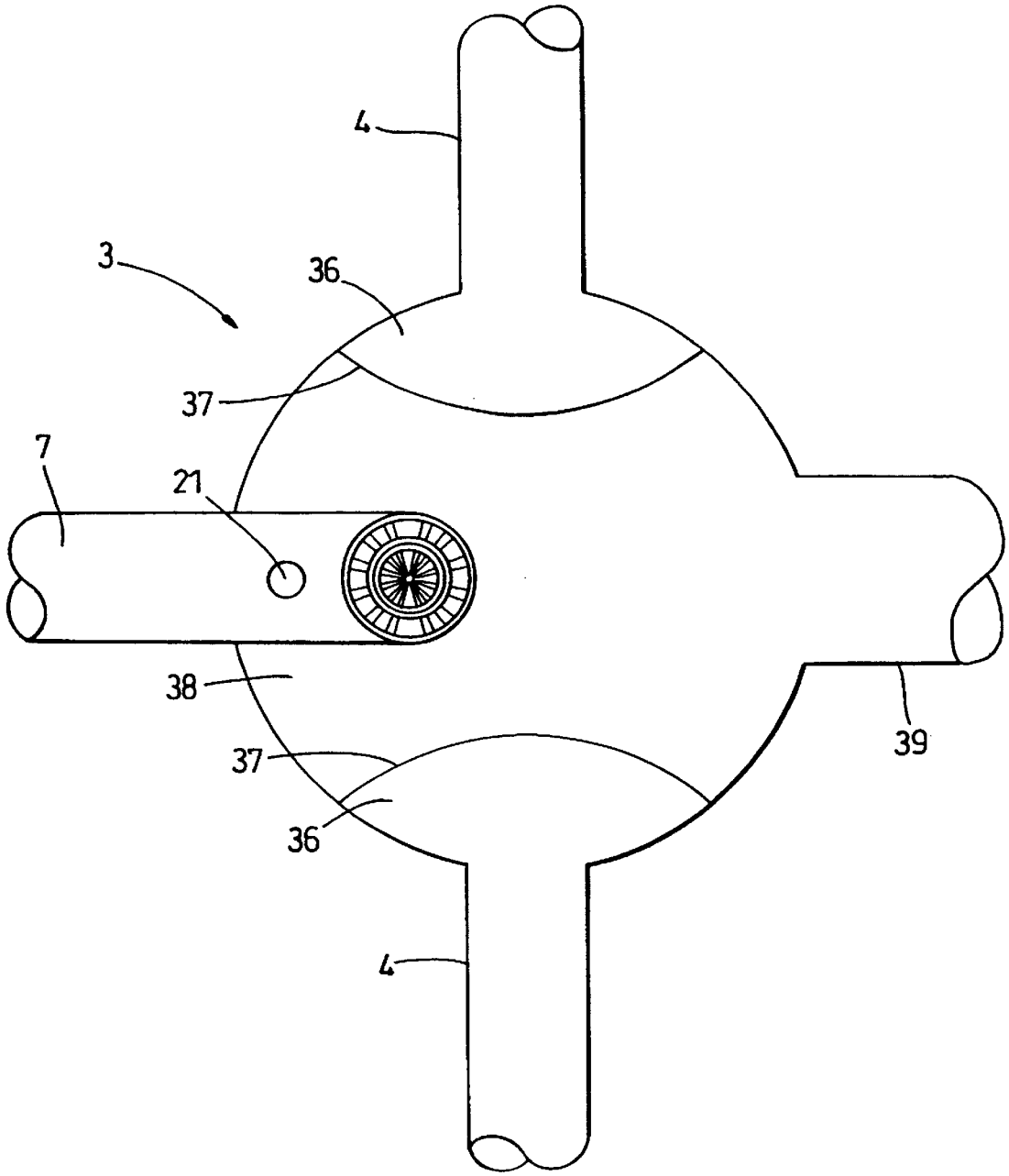
FIG. 6 is a sectional view of an alternative embodiment of the control chamber.
Figure 7:
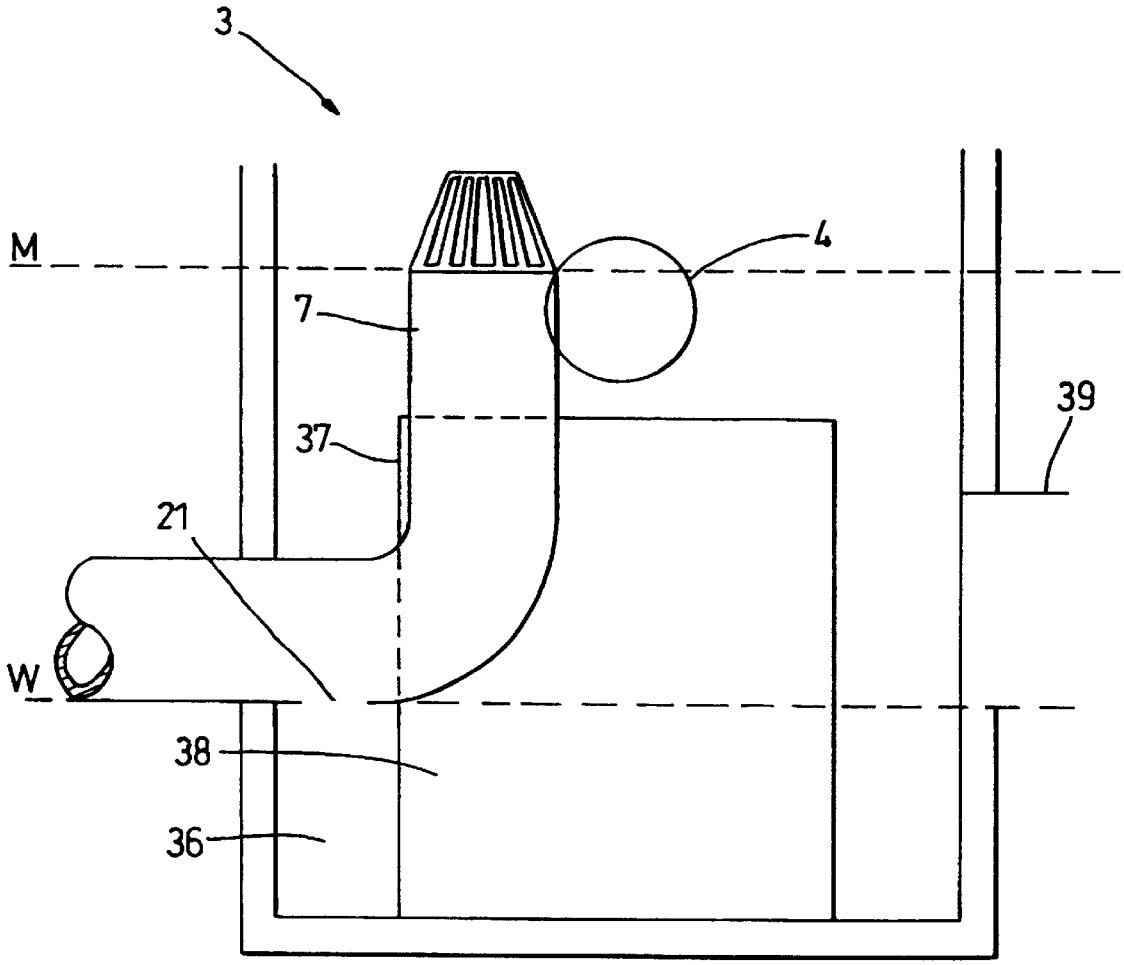
FIG. 7 is a plan view of the control chamber of FIG. 6.

An alternative embodiment of the control chamber is shown in FIGS. 6 and 7. This chamber 3 is formed solely from plastics material, preferably UPVC. As such it is easily located adjacent to the container 6 shown in FIG. 2. It may be attached to a wide variety of other storage containers.

The control chamber 3 is functionally very similar to the hand-built embodiment of FIG. 3. It is of broadly cylindrical form, with a preferred diameter of approximately 475 mm. Two inlet pipes 4, preferably of approximately 100 mm diameter each, lead into an outer section 36 of the control chamber 3, which is separated by a weir 37 from an inner section 38 of the control chamber 3. The weir 37 provides a trap for silt and debris, preventing this from entering the inner section 38 of the control chamber.

An outlet pipe 39 replaces the holes 14 as the inlet to the container 6. It leads from the inner section 38 of the control chamber 3 to the container. The pipe 39 is preferably of approximately 150 mm diameter. As water in the control chamber rises stormwater enters the outlet conduit from the outer section 36 of the control chamber through the orifice 21 in the bottom of the outlet conduit.

The water accumulates in the outer section 36 of the control chamber 3. As the water level in this section rises silt and debris settles to the bottom of the outer section 36 and only water decants over the weir 37 to the inner section 38 of the control chamber.

The outlet 39 allows stormwater to enter the container 6 when the water rises above the water level W. In the event of serious flooding, when the water level in the container rises above the level M, stormwater can then leave also by way of the open end of the pipe 7, which functions as a stormwater overflow in the control chamber 3.

Studies have shown that when collection of stormwater in the control chamber 3 and container 6 abates, the water level therein typically tends to fall by approximately 50 mm each half hour. Therefore, in the occurrence of a thirty year storm event, the storage, comprising the container 6 and the control chamber 3, would empty in one and a half hours and in the occurrence of a one hundred and fifty year storm event, the storage would empty in two and a quarter hours.

The controlled discharge from the control chamber and container is, in a preferred example of the embodiment described, limited by the orifice 21 to 1 litre per second. As a result, the flow through the sewer system 8 will be greatly reduced, thereby enabling installation of smaller capacity off-site storm sewers and the possible elimination of balancing, or reduction of size of balancing. By distributing the storage throughout the development within a private drainage system, the maintenance responsibilities of the Water Authority will also be greatly reduced.

The risk of downstream flooding is significantly reduced. If conduits draining a large balancing pond or tank of the prior art type become blocked, localised flooding could occur. Flood risks are significantly reduced by distributing several storage areas, as shown in the example, around the property development 1.

In the event of, for example, a 300 mm diameter sewer being used instead of a 600 mm diameter sewer at a property development, by use of the apparatus according to the first aspect of the invention, the developer will save in costs of materials, there will be a reduction in dig (to install the sewer) and the adjacent foul sewer will be made shallower in the case of a dual trench sewer construction. Furthermore, considerable savings will be made by the possible elimination of a balancing means such as a large tank or pond on land which could otherwise be used for development.

Once the water level in the container 6 has fallen, there will be a reservoir of stormwater in the container which cannot escape through the holes 14 into the control chamber 3 as the water level is not sufficiently high. This creates a permanently wetted area beneath the garage, typically approximately $3m^3$ per dwelling. Typically, in the double garage 2*a*, this means deepening the garage tanking by approximately 120 mm per dwelling.

The permanently wetted area may be used to provide water, for example, for washing a car, flushing a toilet or watering the garden if a suitable pump is fitted.

What is claimed is:

1. A stormwater retention apparatus to retain stormwater prior to release of the stormwater from a property, comprising:

a closed container located underneath or proximal to a building of the property, being operatively connected by at least one inlet conduit to drainage means sourced externally from the building to receive stormwater into the container, and being further operatively connected to at least one outlet conduit by which stormwater is led away from the container; and a control chamber with which the container is in fluid communication and through which stormwater enters and is to be stored in, and leaves the container when the stormwater reaches a determining level in the control chamber spaced above the base of the container, wherein the inlet and outlet conduits are connected to the control chamber and thereby to the container, and that the outlet conduit comprises an end portion which passes out of the control chamber and includes an entry spaced above the determining level by which stormwater can pass from the control chamber into the end portion to exit from the control chamber, and which by being spaced above the determining level thereby allows stormwater to collect in the container and control chamber above the determining level.

2. The stormwater retention apparatus according to claim 1 characterized in that the inlet conduit is disposed above the level of the entry of the end portion of the outlet conduit.

3. The stormwater retention apparatus according to claim 1 characterized in that the outlet conduit is in fluid communication with a local drainage network on exit from the container.

4. The stormwater retention apparatus according to claim 1 characterized in that the outlet conduit is in fluid communication with a system for reusing stormwater.

5. The stormwater retention apparatus according to claim 1 characterized in that the container is less than 7 $m^3$ in volume.

6. The stormwater retention apparatus according to claim 1 characterized in that the container is made at least in part of bricks and mortar and is lined with a damp proof membrane and concrete.

7. The stormwater retention apparatus according to claim 1 characterized in that the inlet and outlets conduits are pipes.

8. The stormwater retention apparatus according to claim 7 characterized in that the pipes have a diameter of about 75 mm to 150 mm.

9. The stormwater retention apparatus according to claim 1 characterized in that exit rate limiting means is provided whereby the rate of discharge from the apparatus is limited.

10. The stormwater retention apparatus according to claim 1 characterized in that the end portion of the outlet conduit has an orifice in the control chamber at the determining level whereby a restricted flow of stormwater is allowed to pass through the orifice into the outlet conduit when stormwater reaches the determining level in the control chamber and before the level of stormwater in the control chamber reaches the entry of the end portion.

11. The stormwater retention apparatus according to claim 10 characterized in that the end portion has a substantially 90° bend whereby one open end of the end portion is directed upwardly away from the base of the control chamber and forms the entry, and the orifice is provided in the end portion at an underside of the bend.

12. The stormwater retention apparatus according to claim 1 characterized in that the control chamber is located for use below ground level.

13. The stormwater retention apparatus according to claim 1 characterized in that the control chamber and the container are so related in use that the stormwater passes under gravity from the control chamber into the container.

14. The stormwater retention apparatus according to claim 1 characterized in that the control chamber further comprises a trap for debris.

15. The stormwater retention apparatus according to claim 14 characterized in that the trap comprises a weir disposed between a part of the control chamber at which stormwater is received from the inlet conduit and a part of the control chamber in fluid communication with the container.

16. The stormwater retention apparatus according to claim 1 characterized in that the outlet conduit further comprises means at the entry to prevent debris entering the outlet conduit from the control chambre and prevents access for pests into the control chamber from the outlet conduit.

17. The stormwater retention apparatus according to claim 16 characterized in that the means to prevent debris entering comprises a bird-cage cap fitted to the entry.

18. The stormwater retention apparatus according to claim 1 characterized in that it further comprises a pump means for expelling stormwater from the container.

19. A system comprising a building having a stormwater retention apparatus according to claim 1, wherein the container is located underneath or proximal to the building.

20. The system according to claim 19 comprising a series of buildings each of which has stormwater retention apparatus according to any of claims 1 to 18, the stormwater being retained at each apparatus exiting from the container thereof by way of the respective control chamber into a communal local sewer or water course.

21. The system according to claim 19 characterized in that the container of the stormwater retention apparatus is located underground.

22. The system according to claim 19 characterized in that the building comprises a house having a garage, the container of the stormwater retention apparatus being disposed underneath the garage.

23. The system according to claim 19 characterized in that the container is incorporated into the foundation of the building.

24. The system according to claim 19 characterized in that the drainage means to which the stormwater retention apparatus is connected comprises guttering and drainpipes which channel the stormwater to the base of the or the respective building and into the container of the apparatus.

25. The system according to claim 19 characterized in that air bricks are provided in the portions of the building proximal to the respective container.

26. The system according to claim 19 characterized in that condensation isolation means is provided adjacent the container of the stormwater retention apparatus to protect the respective building from the effect of dampness.

27. The system according to claim 26 characterized in that the condensation isolation means comprise polythene membranes and a waterproof coating.

28. A method of retaining and controlling discharge of stormwater collected by drainage means fitted to a building, the method comprising the steps of:

collecting stormwater by drainage means;

retaining the stormwater by a stormwater retention apparatus comprised of a closed container which is located underneath or proximal to a building of the property, being connected by at least one inlet conduit to drainage means sourced externally from the building to receive stormwater into the container, and being further connected to at least one outlet conduit by which stormwater is led away from the container and a control chamber with which the container is in fluid communication and through which stormwater enters and is to be stored in, and leaves the container when the stormwater reaches a determining level in the control chamber spaced above the base of the container, wherein the inlet and outlet conduits are connected to the control chamber and thereby to the container, and that the outlet conduit comprises an end portion which passes out of the control chamber and includes an entry spaced above the determining level by which stormwater can pass from the control chamber into the end portion to exit from the control chamber, and which by being spaced above the determining level allows stormwater to collect in the container and control chamber above the determining level; and controlling release of the retained stormwater by the stormwater retention apparatus into local drainage facilities.

29. The method of retaining and controlling discharge of stormwater according to claim 28 characterized in that the stormwater retention apparatus has the container for retention of the stormwater disposed underneath a garage of the building.

* * * * *